United States Patent [19]

Bauer et al.

[11] Patent Number: 4,828,457

[45] Date of Patent: May 9, 1989

[54] ELBOW CASING FOR FLUID FLOW MACHINES

[75] Inventors: Gerd H. Bauer, Wattenheim; Günter Feldle, Achim; Herbert Hartmüller, Ludwigshafen; Ernst Luhn, Heuchelheim; Alexander Nicklas, Dirmstein; Oliver Schuster, Bobstadt, all of Fed. Rep. of Germany

[73] Assignee: Klein, Schanzlin & Becker Aktiengesellschaft, Frankenthal/Pfalz, Fed. Rep. of Germany

[21] Appl. No.: 86,572

[22] Filed: Aug. 18, 1987

[30] Foreign Application Priority Data

Aug. 20, 1986 [DE] Fed. Rep. of Germany ..... 3628177

[51] Int. Cl.[4] ..... F04D 29/42

[52] U.S. Cl. ..... 415/182.1; 415/224.5

[58] Field of Search ..... 415/182, 206, 208, 201, 415/219 C, 183; 138/171, 39, 56

[56] References Cited

U.S. PATENT DOCUMENTS

| | | | |
|---|---|---|---|
| 1,291,602 | 1/1919 | Murray | 138/171 X |
| 1,310,130 | 7/1919 | Murray, Jr. | 138/171 X |
| 2,671,406 | 3/1954 | Waller | 415/201 X |
| 3,339,490 | 9/1967 | Glass | 415/182 |
| 3,411,451 | 11/1968 | Matthias et al. | 415/183 X |
| 3,421,446 | 1/1969 | Strscheletzky et al. | 415/208 |
| 3,560,105 | 2/1971 | Clifford | 415/182 |
| 3,735,782 | 5/1973 | Strscheletzky | 415/182 X |
| 4,101,243 | 7/1978 | Tatkov et al. | 415/201 |

FOREIGN PATENT DOCUMENTS

| | | | |
|---|---|---|---|
| 3011888 | 10/1981 | Fed. Rep. of Germany | 415/182 |

*Primary Examiner*—Robert E. Garrett
*Assistant Examiner*—Joseph M. Pitko
*Attorney, Agent, or Firm*—Peter K. Kontler

[57] ABSTRACT

A casing which admits the fluid medium into the range of the impeller or first impeller in a fluid flow machine, particularly in a centrifugal pump, is made of several sections which have abutting surfaces. At least one such surface has a recess forming part of a fluid flow passage, and the recess is machined into the respective surface by a material removing tool. This simplifies the making of the casing and enables the latter to optimally conform to the conditions of flow between the supply conduit and the impeller or first impeller of the machine to thus reduce noise and stray movements and enhance the efficiency of the machine.

13 Claims, 2 Drawing Sheets

ELBOW CASING FOR FLUID FLOW MACHINES

BACKGROUND OF THE INVENTION

The invention relates to fluid flow machines in general, especially to centrifugal pumps, and more particularly to improvements in suction casings (called elbow casings) of fluid flow machines.

Many heretofore known elbow casings, wherein a shaft extends through a hole and a passage is provided for the flow of fluid medium substantially radially of and toward the shaft, are castings which are designed for ideal flow conditions. It has been found that such situations do not develop too often in actual practice when a centrifugal pump is associated or series or otherwise connected with (especially installed downstream of) numerous fluid flow controlling and/or guiding components including valves, gates, compensators, elbows and/or others. In many instances, such components can exert an adverse influence upon the profile of the flow in the pipeline and at the inlet to the pump. Since the maker of pumps is often not informed of the nature and/or number of components which are to be installed upstream of the pump, it happens again and again that the cross-sectional area of the flow path ahead of the pump, the profile of the flow and the passage in the elbow casing of the pump are out of harmony. This can enhance the development of noise and/or cause a reduction of the efficiency of the pump and, due to unsatisfactory flow of incoming fluid, can lead to a less satisfactory NPSH (net positive suction head) and to cavitation with resulting damage to important parts of the pump.

OBJECTS AND SUMMARY OF THE INVENTION

An object of the invention is to provide a casing, particularly an elbow casing, which can be used in a fluid flow machine, especially in a centrifugal pump, and is constructed and assembled in such a way that it can eliminate at least the majority of aforediscussed problems which arise in connection with the installation and utilization of conventional elbow casings.

Another object of the invention is to provide a fluid flow machine which embodies the above outlined elbow casing.

A further object of the invention is to provide a single-stage or multi-stage centrifugal pump which embodies the above outlined elbow casing.

An additional object of the invention is to provide an elbow casing which can be readily taken apart and reassembled with little loss in time.

A further object of the invention is to provide a novel method of providing an elbow casing with a fluid flow passage.

Still another object of the invention is to provide an elbow casing which can be used with advantage in existing types of centrifugal pumps and like fluid flow machines.

The invention is embodied in a fluid flow machine, particularly in a centrifugal pump, of the type wherein a shaft is rotatable about a predetermined axis and the fluid to be conveyed by the machine is caused to flow substantially radially of and toward the axis of the shaft. The machine comprises a casing, particularly an elbow casing, which includes at least two neighboring sections having rather closely or immediately adjacent surfaces which are disposed at least substantially at right angles to the axis of the shaft. The casing defines a hole or bore for the shaft of the fluid flow machine and a passage for the flow of fluid. At least a portion of the passage is machined into at least one of the aforementioned surfaces, i.e., the passage is formed (at least in part) by removing material from the respective section or sections of the casing.

The casing can include two sections each of which includes a cover. Alternatively, the casing can comprise two sections one of which constitutes a cover for the other section. Still further, the casing can comprise three sections including two covers which flank an intermediate section.

The casing can further comprise at least one annular insert which defines a portion of the aforementioned hole or bore. Such insert can be at least partially surrounded by (e.g., simply confined in) at least one of the aforementioned sections.

Alternatively, or in addition to the just discussed insert, the casing can further comprise a fluid flow directing insert. Such insert can define a portion at least of the fluid flow passage and can be at least partially surrounded by in (e.g., simply recessed into) at least one of the sections.

The casing can also comprise one or more relatively thin linings for the fluid flow passage.

Impeller means can be located adjacent one of the sections, and the passage comprises a discharge end which is adjacent the impeller means.

The novel features which are considered as characteristic of the invention are set forth in particular in the appended claims. The improved fluid flow machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
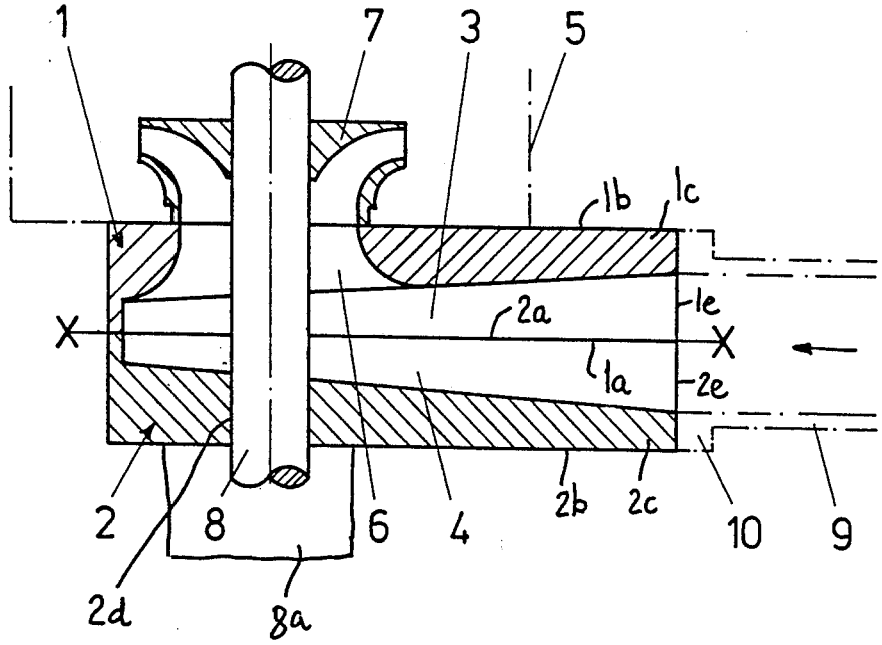
FIG. 1 is a fragmentary sectional view of a centrifugal pump having an elbow casing which embodies one form of the invention.

FIG. 1 shows a portion of a centrifugal pump which comprises an elbow casing with two substantially plate-like and substantially mirror symmetrical sections 1 and 2. The two sections have preferably flat inner surfaces 1*a*, 2*a* which are immediately or closely adjacent each other in a plane X—X extending at right angles to the axis of a pump shaft 8 carrying an impeller 7 adjacent the outer side or surface 1*b* of the section 1. The pump casing is indicated by phantom lines, as at 5; this casing can form part of a single-stage or a multi-stage centrifugal pump. The plane X—X is located substantially midway between the outer sides or surfaces 1*b*, 2*b* of the sections 1, 2 and each of these sections includes a cover 1c, 2c, respectively. The covers define the respective outer sides 1b, 2b and are spaced apart from the plane X—X. The reference characters 3 and 4 denote two recesses which are machined into the inner surfaces 1a, 1b and together form the major part of a fluid flow passage wherein the admitted fluid flows radially of and toward the axis of the shaft 8. The thickness of the section 1 can match or approximate the thickness of the section 2. The recesses 3 and 4 are formed as a result of removal of material from the inner surfaces 1a, 2a of the blanks which are thereby converted into the sections 1 and 2. For example, removal of material can take place in a milling machine. The section 1 is further formed with an opening 6 which surrounds the adjacent portion of the shaft 8 and constitutes an extension of that portion of the fluid flow passage which is defined by the recesses 3 and 4. The opening 6 directs the flow toward the impeller 7 in the first or only stage of the pump which includes the elbow casing and the pump casing 5. The section 2 has an opening 2d (e.g., a hole or bore) for the respective portion of the pump shaft 8 which drives the impeller 7 if the improved fluid flow machine is used as a pump. A shaft bearing 8a can be secured to the outer side 2a of the section 2 by screws or other suitable fasteners.

The reference character 9 denotes a supply or suction conduit (shown by phantom lines) having a flange 10 which is directly secured to the adjacent end faces 1e, 2e of the sections 1, 2 so as to admit the incoming fluid medium into the adjacent end portion of the passage including the recesses 3, 4 and the opening 6. The surfaces bounding the recesses 3 and 4 are machined in such a way that they allow for direct and disturbance-free flow of fluid medium from the conduit 9 into and through the two-piece elbow casing including the sections 1 and 2.

The sections 1 and 2 can be separably or more or less permanently secured to each other by screws, by bolts and nuts or by other suitable fastener means. Suitable sealing pads or annular or otherwise configurated sealing elements can be installed in the plane X—X to seal the passage including the recesses 3, 4 and the opening 6 from the atmosphere. It is also possible to weld the section 1 to the section 2 or to rigidly and sealingly connect such sections 1 and 2 to each other by means of clamps or by other unthreaded fastener means.

The section 2 and/or the section 1 can be permanently or separably connected to the pump casing 5.

Figure 2:
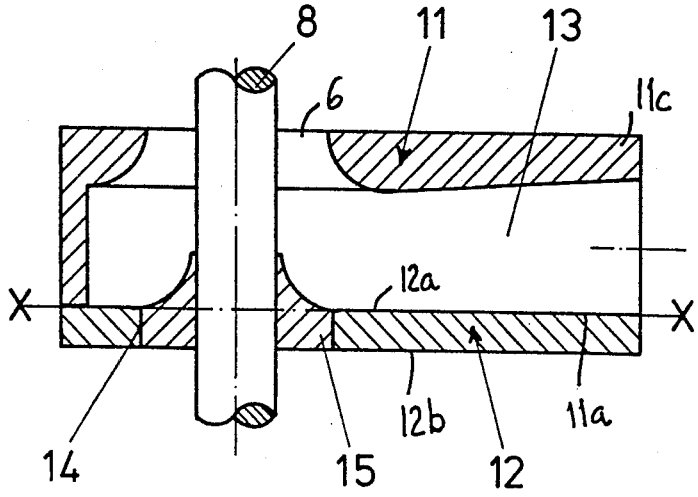
FIG. 2 is a similar fragmentary sectional view of a second pump having a modified casing.

FIG. 2 shows a portion of a modified pump wherein the impeller(s), the pump casing and the supply conduit are omitted for the sake of clarity. The sections 11, 12 of the composite elbow casing are immediately or closely adjacent each other in a plane X—X which is closely adjacent the outer side 12b of the section 12. The latter constitutes a cover for the passage which includes a recess 13 and an opening 6 machined into the inner surface 11a of the section 11. The shaft 8 extends centrally through the opening 6 as well as through the axial bore or hole of an annular insert 15 which is installed in the section or cover 12 by being recessed into a hole or bore 14 of the section 12. An advantage of the elbow casing including the sections 11 and 12 is that the section or cover 12 requires little or no machining, i.e., its inner surface 12a need not be provided with a recess. The section 12 is simply a plate having a desired thickness and being provided with the hole 14 for the insert 15. That portion of the insert 15 which extends into the fluid flow passage tapers in a direction toward the opening 6 to guide the incoming fluid toward and into the opening 6 and thence into the single stage or into the first stage of the pump. The section 11 includes a cover 11c and an inner portion which is formed with the recess 13. The outer end face of the insert 15 is adjacent a bearing (not shown in FIG. 2) which corresponds to the shaft bearing 8a of FIG. 1. The insert 15 further performs the function of a friction bearing for the adjacent portion of the shaft 8 in addition to the function of a flow directing body which ensures that the inflowing fluid medium is properly diverted from the recess 13 into the opening 6 of the fluid flow passage.

Figure 3:
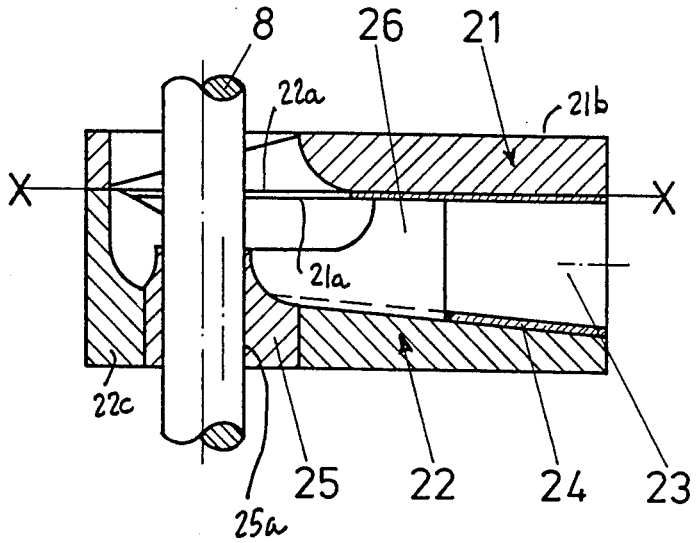
FIG. 3 is a similar fragmentary sectional view of a third pump having a casing wherein the passage for the admission of fluid is surrounded by a lining.

Referring to FIG. 3, there is shown a further elbow casing having a first section 21 in the form of a cover adjacent the pump casing (not shown) and the impeller (not shown) of the single stage or first stage of the pump. The second section 22 of the elbow casing which is shown in FIG. 3 is formed with a recess 23 defining the major portion of the fluid flow passage and serving to convey incoming fluid medium into an opening surrounding the adjacent portion of the shaft 8, namely that portion which extends between the inner and outer surfaces 21a and 21b of the section or cover 21. The plane X—X is adjacent the inner surfaces 21a and 22a. The section 22 has a hole for an insert 25 which surrounds the respective portion of the shaft 8 and is recessed in the section 22. This insert can serve as a friction bearing for the shaft 8 and also as a means for directing the flow of incoming fluid toward the opening in the section or cover 21. A portion of the passage which is defined by the sections 21, 22 is surrounded by a lining 24. The material of this lining is preferably highly resistant to wear and/or the lining has an exceptionally smooth internal surface to guide the inflowing liquid toward the opening in the section or cover 21 with a minimum of resistance. The insert 25 is asymmetric with reference to the shaft 8, i.e., the hole for this insert in the cover 22c of the section 22 is eccentric with reference to the shaft. A flow enhancing and directing projection in the form of a rib 26 is inserted into the passage including the recess 23. A portion of this rib is located downstream of the lining 24. The projection 26 can constitute an integral (machined) part of the section 22.

FIGS. 2 and 3 show that the part which constitutes a coverlike section can be adjacent the impeller (FIG. 3) or that such part can be remote from the impeller (FIG. 2).

The inserts 15 and 25 are preferably removable so that they can be replaced after certain periods of use. These inserts can perform plural functions, namely the aforementioned functions of bearings for the respective shafts 8 and of means for directing the flow of admitted fluid medium; in addition, such inserts can serve as a means for sealing the hole 14 or 25a so that the machine can employ a simpler shaft bearing or a simpler shaft seal. Moreover, the inserts can be removed to afford access to the interior of the elbow casing, e.g., to examine the condition of surfaces bounding the fluid flow passage.

One or more linings 24 or analogous linings will be used when the conveyed fluid medium is likely to react with the material of the sections. Moreover, a lining can be used to reduce or eliminate wear upon the adjacent surfaces of the sections 21, 22; to this end, the lining is exchangeable so that it can be replaced from time to time after having undergone a certain amount of wear as a result of contact with solid particles in the conveyed fluid medium and/or as a result of continuous or repeated contact with a corrosive fluid medium. Another purpose of the lining or linings 24 is to render it unnecessary to machine the adjacent surfaces of the sections 21 and 22 with a high degree of precision, i.e., the adjacent surfaces of the sections 21, 22 can remain rough if they are properly lined with a wear- and/or corrosion-resistant material forming a lining with a smooth internal surface to facilitate the flow of the admitted fluid medium into the first or single stage of the pump. For example, the surfaces bounding the lining 24 of FIG. 3 can be machined with a roughing cutter without any secondary treatment. This reduces the overall cost of the fluid flow machine. Still further, the lining or linings can serve to overlie undercuts and like configurations which would be likely to gather a fluid medium and to enable such fluid medium to stagnate somewhere between the supply conduit and the impeller or impellers. Thus, the sections of the elbow casing can be machined only with a degree of precision which is necessary to ensure that a properly inserted lining will adequately guide the admitted fluid medium toward the impeller or impellers.

Figure 4:
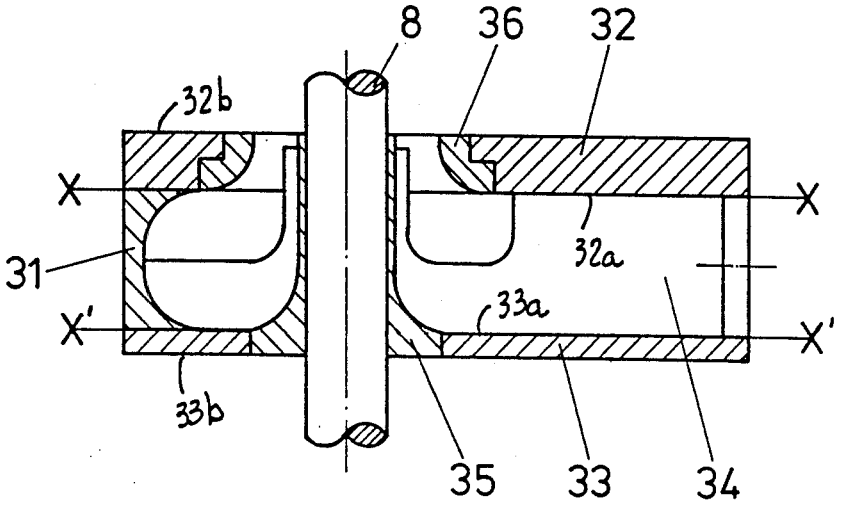
FIG. 4 is a similar fragmentary sectional view of a fourth pump wherein a triple-section casing comprises a shaft bearing in line with a flow directing insert.

FIG. 4 shows a portion of a further fluid flow machine wherein the elbow casing comprises three sections, namely two covers 32, 33 and an intermediate section 31 having a recess forming part of the fluid flow passage. The sections of FIG. 4 abut or are closely adjacent each other (in pairs) in the planes X—X and X'—X'. Such planes are parallel to each other and are respectively adjacent the inner surfaces 32*a*, 33*a* of the respective covers 32, 33. The cover 32 is adjacent the pump casing, and the cover 33 is adjacent the bearing for the shaft 8. The recess of the section 31 contains a guide element in the form of a plate-like or sheet-like vane 34 which directs the inflowing fluid medium toward the opening in a ring-shaped flow-directing insert 36 received in the section or cover 32. A second insert 35 is installed in the section or cover 33 and surrounds the shaft 8 all the way to the outer side or surface 32*b* of the section or cover 32. A portion of the insert 35 serves as a flow directing means to ensure a predictable flow of fluid medium from the recess of the section 31 toward and into the flow directing insert 36 in the cover or section 32. The insert 35 can be said to constitute a substantially tubular protector for the shaft 8 between the outer side 33*b* of the cover 33 and the outer side 32*b* of the cover 32. The insert 36 is preferably exchangeable so that it can serve as a highly satisfactory flow directing and guiding means under a number of different circumstances. For example, the pump including the structure of FIG. 4 can be furnished with several inserts 36, one for each of several conduits (not shown) which are used to convey fluid medium at a different rate. Each such conduit can have a different inner diameter.

The improved pump can be furnished with several sets of sections so that the user of the pump can select and combine those sections (e.g., two sections or three sections) which together form a casing that is best suited for a particular application. The same holds true for various shaft-surrounding and/or other inserts and linings, i.e., such parts can be furnished in different sizes and/or shapes to ensure proper guidance of the fluid medium from the receiving end of the fluid flow passage toward the impeller of the single stage of a one-stage pump or toward the impeller of the foremost stage of a multi-stage pump.

An important advantage of the improved pump and of its elbow casing is that the configuration of surfaces bounding the fluid flow passage can readily conform to requirements in connection with the intended or actual use of the fluid flow machine. Thus, the material removing machine can provide one or more recesses in a single section, in both sections or in all three sections of a multi-section elbow casing. The configuration of surfaces bounding the fluid flow passage will be selected with a view to ensure proper conformance with the dimensions and/or other parameters of the fluid supplying means as well as to the configuration of the inlet to the single impeller of a single-stage pump or to the foremost impeller of a multi-stage pump. Proper selection of the configuration of surfaces bounding the fluid flow passage invariably enhances the efficiency and the NPSH of the fluid flow machine. Moreover, the machine generates less noise and exhibits a much less pronounced tendency to perform vibratory and/or other stray movements.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a fluid flow machine, particularly in a centrifugal pump, wherein a shaft is rotatable about a predetermined axis and the fluid to be conveyed by the machine flows substantially radially of and toward such axis, the combination of a pump casing and an elbow casing, said elbow casing being rigid with said pump casing and comprising at least two neighboring sections having closely or immediately adjacent surfaces disposed at least substantially at right angles to said predetermined axis, said elbow casing defining a hole for the shaft of the fluid flow machine and a passage for the flow of fluid, at least a portion of said passage being machined into at least one of said surfaces.

2. The structure of claim 1, wherein said elbow casing comprises three sections including two covers and an additional section between said covers.

3. The structure of claim 1, wherein said elbow casing further comprises at least one annular insert defining a portion at least of said hole.

4. The structure of claim 3, wherein said insert is at least partly surrounded by at least one of said sections.

5. The structure of claim 1, wherein said elbow casing comprises at least one fluid flow directing insert.

6. The structure of claim 5, wherein said insert defines a portion of said passage and is at least partially surrounded by at least one of said sections.

7. The structure of claim 1, further comprising impeller means adjacent one of said sections, said passage having a discharge end adjacent said impeller means.

8. The structure of claim 1, wherein said elbow casing is disposed externally of said pump casing.

9. The structure of claim 8, wherein said elbow casing is located upstream of said pump casing as considered in the direction of fluid flow substantially radially of and toward said predetermined axis.

10. The structure of claim 1, further comprising an impeller fast with said shaft.

11. In a fluid flow machine, particularly in a centrifugal pump, wherein a shaft is rotatable about a predetermined axis and the fluid to be conveyed by the machine flows substantially radially of and toward such axis, the combination of a pump casing and an elbow casing, said elbow casing being rigid with said pump casing and comprising at least two neighboring sections having closely or immediately adjacent surfaces disposed at least substantially at right angles to said predetermined axis, said elbow casing defining a hole for the shaft of the fluid flow machine and a passage for the flow of fluid, and at least a portion of said passage being machined into at least one of said surfaces, said elbow casing comprising two sections each of which includes a cover.

12. In a fluid flow machine, particularly in a centrifugal pump, wherein a shaft is rotatable about a predetermined axis and the fluid to be conveyed by the machine flows substantially radially of and toward such axis, the combination of a pump casing and an elbow casing, said elbow casing being rigid with said pump casing and comprising at least two neighboring sections having closely or immediately adjacent surfaces disposed at least substantially at right angles to said predetermined axis, said elbow casing defining a hole for the shaft of the fluid flow machine and a passage for the flow of fluid, and at least a portion of said passage being machined into at least one of said surfaces, said elbow casing including two sections one of which constitutes a cover for the other of said sections.

13. In a fluid flow machine, particularly in a centrifugal pump, wherein a shaft is rotatable about a predetermined axis and the fluid to be conveyed by the machine flows substantially radially of and toward such axis, the combination of a pump casing and an elbow casing, said elbow casing being rigid with said pump casing and comprising at least two neighboring sections having closely or immediately adjacent surfaces disposed at least substantially at right angles to said predetermined axis, said elbow casing defining a hole for the shaft of the fluid flow machine and a passage for the flow of fluid, and at least a portion of said passage being machined into at least one of said surfaces, said elbow casing further comprising at least one lining for said passage.

* * * * *